United States Patent [19]

Pietrowski et al.

[11] Patent Number: 5,016,055

[45] Date of Patent: May 14, 1991

[54] METHOD AND APPARATUS FOR USING VIBRATORY ENERGY WITH APPLICATION OF TRANSFER FIELD FOR ENHANCED TRANSFER IN ELECTROPHOTOGRAPHIC IMAGING

[75] Inventors: Kenneth W. Pietrowski, Penfield; Charles A. Radulski, Macedon, both of N.Y.

[73] Assignee: Xerox Corporation, Stamford, Conn.

[21] Appl. No.: 548,351

[22] Filed: Jul. 2, 1990

[51] Int. Cl.[5] ..... G03G 15/14

[52] U.S. Cl. ..... 355/273; 310/323; 310/325; 355/271

[58] Field of Search ..... 134/1; 73/862.59; 355/271, 273, 296; 118/652; 310/325, 323

[56] References Cited

U.S. PATENT DOCUMENTS

| | | | |
|---|---|---|---|
| 3,113,225 | 12/1963 | Kleesattel et al. | 310/26 |
| 3,190,793 | 6/1965 | Starke | 162/278 |
| 3,370,186 | 2/1968 | Antonevich | 310/325 |
| 3,422,479 | 1/1969 | Jeffee | 15/100 |
| 3,483,034 | 12/1969 | Ensminger | 134/1 |
| 3,635,762 | 1/1972 | Ott et al. | 134/1 |
| 3,653,758 | 4/1972 | Trimmer et al. | 355/16 |
| 3,713,987 | 1/1973 | Low | 195/127 |
| 3,733,238 | 5/1973 | Long et al. | 156/580 |
| 3,854,974 | 12/1974 | Sato et al. | 117/17 |
| 4,007,982 | 2/1977 | Stange | 355/299 |
| 4,111,546 | 9/1978 | Maret | 355/297 |
| 4,112,299 | 9/1978 | Davis | 250/326 |
| 4,121,947 | 10/1978 | Hemphill | 134/1 |
| 4,210,837 | 7/1980 | Vasiliev et al. | 310/323 |
| 4,363,992 | 12/1982 | Holze, Jr. | 310/323 |
| 4,434,384 | 2/1984 | Dunnrowicz et al. | 310/325 |
| 4,483,571 | 11/1984 | Mishiro | 310/323 |
| 4,546,722 | 10/1985 | Toda et al. | 118/657 |
| 4,651,043 | 3/1987 | Harris et al. | 310/323 |
| 4,684,242 | 8/1987 | Schultz | 355/307 |
| 4,728,843 | 3/1988 | Mishiro | 310/325 |
| 4,794,878 | 1/1989 | Connors et al. | 118/653 |
| 4,812,697 | 3/1989 | Mishiro | 310/323 |
| 4,833,503 | 5/1989 | Snelling | 355/259 |
| 4,954,742 | 9/1990 | Izukawa | 310/323 X |

FOREIGN PATENT DOCUMENTS

| | | | |
|---|---|---|---|
| 0037042 | 3/1977 | Japan | 355/273 |
| 0113549 | 10/1978 | Japan | 355/271 |
| 62-195685 | 8/1987 | Japan . | |

OTHER PUBLICATIONS

Xerox Disclosure Journal; "Floating Diaphragm Vacuum Shoe"; vol. 2; No. 6; Nov./Dec.; 1977; pp. 117–118.

Defensive Publications; T893,001; 12/14/71; Fisler.

*Primary Examiner*—A. T. Grimley
*Assistant Examiner*—Sandra L. Hoffman
*Attorney, Agent, or Firm*—Mark Costello

[57] ABSTRACT

An electrophotographic device includes a flexible belt-type charge retentive member, bearing a developed latent image and brings a sheet of paper or other transfer member into intimate contact with the charge retentive surface at a transfer station for electrostatic transfer of toner from the charge retentive surface to the sheet. At the transfer station, a resonator suitable for generating vibratory energy is arranged in line contact with the back side of the charge retentive, to uniformly apply vibratory energy to the charge retentive member surface at a position opposite the transfer coronode or peak transfer field, or slightly upstream therefrom. Toner is released from the electrostatic and mechanical forces adjering it to the charge retentive surface at the line contact position.

28 Claims, 13 Drawing Sheets

METHOD AND APPARATUS FOR USING VIBRATORY ENERGY WITH APPLICATION OF TRANSFER FIELD FOR ENHANCED TRANSFER IN ELECTROPHOTOGRAPHIC IMAGING

This invention relates to reproduction apparatus, and more particularly, to a method and apparatus for applying vibratory energy to an imaging surface to reduce transfer deletions in electrophotographic applications.

CROSS REFERENCE

Cross reference is made to copending U.S. patent application Ser. No. 07/368,044, entitled "High Frequency Vibratory Enhanced Cleaning in an Electrostatic Imaging Device", assigned to the same assignee as the present invention; and to concurrently filed United States Patent Applications assigned to the present assignee and entitled: "Frequency Sweeping Excitation of High Frequency Vibratory Energy Producing Devices for Electrophotographic Imaging" by inventors R. Stokes et al. and assigned U.S. patent application Ser. No. 7/548,645; "Method and Apparatus for Using Vibratory Energy to Reduce Transfer Deletions in Electrophotographic Imaging" by inventor C. Snelling and assigned U.S. patent application Ser. No. 7/548,352; "Vacuum Coupling Arrangement for Applying Vibratory Motion to a Flexible Planar Member" by inventors C. Snelling et al. and assigned U.S. patent application Ser. No. 7/548,350; "Segmented Resonator Structure Having a Uniform Response for Electrophotographic Imaging" by inventors W. Nowak et al. and assigned U.S. patent application Ser. No. 7/548,517; "Edge Effect Compensation in High Frequency Vibratory Energy Producing Devices for Electrophotographic Imaging" by inventors W. Nowak et al. and assigned U.S. patent application Ser. No. 7/548,318.

BACKGROUND OF THE INVENTION

In electrophotographic applications such as xerography, a charge retentive surface is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder or powder suspension referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known and useful for light lens copying from an original and printing applications from electronically generated or stored originals, where a charged surface may be imagewise discharged in a variety of ways. Ion projection devices where a charge is imagewise deposited on a charge retentive substrate operate similarly. In a slightly different arrangement, toner may be transferred to an intermediate surface, prior to retransfer to a final substrate.

Transfer of toner from the charge retentive surface to the final substrate is commonly accomplished electrostatically. A developed toner image is held on the charge retentive surface with electrostatic and mechanical forces. A substrate (such as a copy sheet) is brought into intimate contact with the surface, sandwiching the toner thereinbetween. An electrostatic transfer charging device, such as a corotron, applies a charge to the back side of the sheet, to attract the toner image to the sheet.

Unfortunately, the interface between the sheet and the charge retentive surface is not always optimal. Particularly with non-flat sheets, such as sheets that have already passed through a fixing operation such as heat and/or pressure fusing, or perforated sheets, or sheets that are brought into imperfect contact with the charge retentive surface, the contact between the sheet and the charge retentive surface may be non-uniform, characterized by gaps where contact has failed. There is a tendency for toner not to transfer across these gaps. A copy quality defect referred to as transfer deletion results.

The problem of transfer deletion has been unsatisfactorily addressed by mechanical devices that force the sheet into the required intimate and complete contact with the charge retentive surface. Blade arrangements that sweep over the back side of the sheet have been proposed, but tend to collect toner if the blade is not cammed away from the charge retentive surface during the interdocument period, or frequently cleaned. Biased roll transfer devices have been proposed, where the electrostatic transfer charging device is a biased roll member that maintains contact with the sheet and charge retentive surface. Again, however, the roll must be cleaned. Both arrangements can add cost, and mechanical complexity.

That acoustic agitation or vibration of a surface can enhance toner release therefrom is known. U.S. Pat. No. 4,111,546 to Maret proposes enhancing cleaning by applying high frequency vibratory energy to an imaging surface with a vibratory member, coupled to an imaging surface at the cleaning station to obtain toner release. The vibratory member described is a horn arrangement excited with a piezoelectric transducer (Piezoelectric element) at a frequency in the range of about 20 kilohertz. U.S. Pat. No. 4,684,242 to Schultz describes a cleaning apparatus that provides a magnetically permeable cleaning fluid held within a cleaning chamber, wherein an ultrasonic horn driven by piezoelectric transducer element is coupled to the backside of the imaging surface to vibrate the fluid within the chamber for enhanced cleaning. U.S. Pat. No. 4,007,982 to Stange provides a cleaning blade with an edge vibrated at a frequency to substantially reduce the frictional resistance between the blade edge and the imaging surface, preferably at ultrasonic frequencies. U.S. Pat. No. 4,121,947 to Hemphill provides an arrangement which vibrates a photoreceptor to dislodge toner particles by entraining the photoreceptor about a roller, while rotating the roller about an eccentric axis. Xerox Disclosure Journal "Floating Diaphragm Vacuum Shoe, by Hull et al., Vol. 2, No. 6, Nov./Dec. 1977 shows a vacuum cleaning shoe wherein a diaphragm is oscillated in the ultrasonic range. U.S. Pat. No. 3,653,758 to Trimmer et al., suggests that transfer of toner from an imaging surface to a substrate in a non contacting transfer electrostatic printing device may be enhanced by applying vibratory energy to the backside of an imaging surface at the transfer station. U.S. Pat. No. 4,546,722 to Toda et al., U.S. Pat. No. 4,794,878 to Connors et al., and U.S. Pat. No. 4,833,503 to Snelling disclose use of a piezoelectric transducer driving a resonator for the enhancement of development within a developer housing. Japanese Published Patent Appl. No. 62-195685 suggests that imagewise transfer of photoconductive toner, discharged in imagewise fashion, from a toner retaining surface to a substrate in a printing device may be enhanced by applying vibratory energy to the backside of the toner retaining surface. U.S. Pat. No. 3,854,974 to Sato et al. discloses vibration simultaneous with transfer across pressure engaged surfaces. However, this patent does not address the problem of deletions in association with corotron transfer.

Resonators for applying vibrational energy to some other member are known, for example in U.S. Pat. No. 4,363,992 to Holze, Jr. which shows a horn for a resonator, coupled with a piezoelectric transducer device supplying vibrational energy, and provided with slots partially through the horn for improving non uniform response along the tip of the horn. U.S. Pat. No. 3,113,225 to Kleesattel et al. describes an arrangement wherein an ultrasonic resonator is used for a variety of purposes, including aiding in coating paper, glossing or compacting paper and as friction free guides. U.S. Pat. No. 3,733,238 to Long et al. shows an ultrasonic welding device with a stepped horn. U.S. Pat. No. 3,713,987 to Low shows ultrasonic agitation of a surface, and subsequent vacuum removal of released matter.

Coupling of vibrational energy to a surface has been considered in Defensive Publication T893,001 by Fisler which shows an ultrasonic energy creating device is arranged in association with a cleaning arrangement in a xerographic device, and is coupled to the imaging surface via a bead of liquid through which the imaging surface is moved. U.S. Pat. No. 3,635,762 to Ott et al. and U.S. Pat. No. 3,422,479 to Jeffee show a similar arrangement where a web of photographic material is moved through a pool of solvent liquid in which an ultrasonic energy producing device is provided. U.S. Pat. No. 4,483,034 to Ensminger shows cleaning of a xerographic drum by submersion into a pool of liquid provided with an ultrasonic energy producing device. U.S. Pat. No. 3,190,793 Starke shows a method of cleaning paper making machine felts by directing ultrasonic energy through a cleaning liquid in which the felts are immersed.

It has been noted that even with fully segmented horns, as shown in copending application assigned to the same assignee as the present application, and entitled, "Segmented Resonator Structure having a Uniform Response for Electrophotographic Imaging" by inventors W. Nowak et al. and assigned Ser. No. 7/548,517, there is a fall-off in response of the resonator at the outer edges of the device. A similar fall off is shown in U.S. Pat. No. 4,363,992 to Holze, Jr., at FIG. 2, showing the response of the resonator of FIG. 1.

All the references cited herein are specifically incorporated by reference for their teachings.

SUMMARY OF THE INVENTION

In accordance with the invention there is provided a method and apparatus for applying vibratory energy to the charge retentive surface of an electrophotographic device at an area adjacent the transfer zone to cause mechanical release of a toner image from the charge retentive surface for enhanced transfer across gaps caused by non-intimate sheet contact with the charge retentive surface.

In accordance with one aspect of the invention, an electrophotographic device of the type contemplated by the present invention includes a non-rigid member having a charge retentive surface, driven along an endless path through a series of processing stations that create a latent image on the charge retentive surface, develop the image with toner, and bring a sheet of paper or other transfer member into intimate contact with the charge retentive surface at a transfer station for electrostatic transfer of toner from the charge retentive surface to the sheet. At the transfer station, a resonator suitable for generating relatively high frequency vibratory energy is arranged in line contact with the back side of the non-rigid member, to uniformly apply vibratory energy thereto. Toner is released from the electrostatic and mechanical forces adhering it to the charge retentive surface at the line contact position. For optimum operation is it has been determined that the optimum position of the resonator, is at a location prior to but near, or opposite the position where the field is at the peak value. In a large number of cases, this position corresponds to the coronode position. However, for various reasons, a corona transfer device may have a tailored field response such as that shown in U.S. Pat. No. 4,112,299 to Davis, in which case, the desired position is near the peak of the field.

Toner transfer to paper or other desirable substrate is enabled by an electrostatic force approximated by the product of qE where q is the charge on a toner particle and E is the transfer field. The qE force in the direction of the surface to which toner is to be transferred must be large enough to overcome the retarding electrical and mechanical adhesion/cohesion forces retaining toner and debris on the photoreceptor. The upper boundary of the allowable E field value is dictated by Paschen breakdown limits for air. In the case of small airgaps caused by toner in the transfer member/toner/charge retentive surface interface, the Paschen breakdown field is very sensitive to spacing and inversely proportional to it. Airgaps of undesirable magnitudes can be created between the paper and photoreceptor by a variety of causes. The paper itself may not be flat or some debris such as a toner agglomerate or carrier beads creates localized tenting. Fixing the problem requires that either the source of the gap be eliminated or that transfer be enabled at field levels below Paschen breakdown limits. Toner transfer to paper is not necessarily instantaneous, and may proceed at a rate governed to some extent by material properties and the rate at which the field increases as the toner bearing surface moves through the transfer zone. Toner particles are of a polarity opposite to that of the field producing charge deposited on the rear of the substrate by corona. The magnitude of the transfer field across an airgap at any instant in the transfer zone is a consequence of the net charge on the paper side of the gap resulting from that delivered by the corona device and the amount of opposite polarity toner that has transferred. The net field is lower when some toner transfers. If the rate of toner transfer is sufficient to keep the resulting instantaneous field below Paschen breakdown, additional charge can be delivered to the paper enabling further and more complete transfer of the developed image. This behavior implies that desirable rate limited transfer can be accommodated by tailoring the "in process direction" E field current associated with the corona device. A transfer field that rises slowly as paper progresses into the transfer zone may be desirable. One way of accomplishing such a field profile is to utilize a wide corotron or enable a transfer zone comprised of several transfer steps. Since real estate around the photoreceptor is costly, these approaches are not desirable.

An acoustic transfer assist method has been described by Method and Apparatus for Using Vibratory Energy to Reduce Transfer Deletions in Electrophotographic Imaging, by C. Snelling, a United States Patent Application, copending with the present application and assigned to the same assignee as the present application, and suggests the use of an ultrasonic device to couple acoustic energy to the photoreceptor as a means of breaking the toner/photoreceptor or toner/toner bonds. The objective is to enable low field transfer (lower qE) by placing the device behind the P/R in the vicinity of the transfer corotron.

These and other aspects of the invention will become apparent from the following description used to illustrate a preferred embodiment of the invention read in conjunction with the accompanying drawings in which.

Figure 11A:
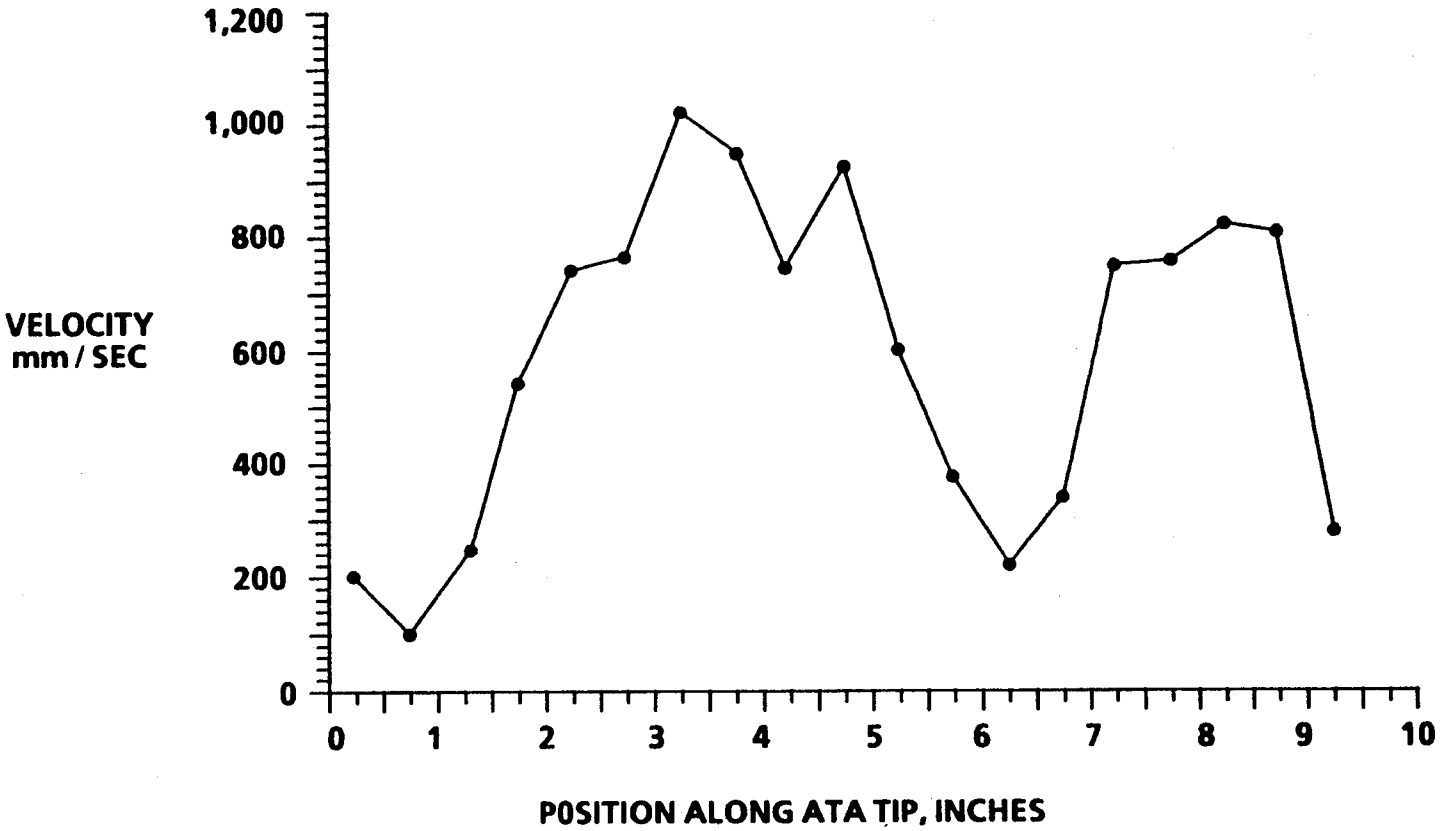
Figure 11B:
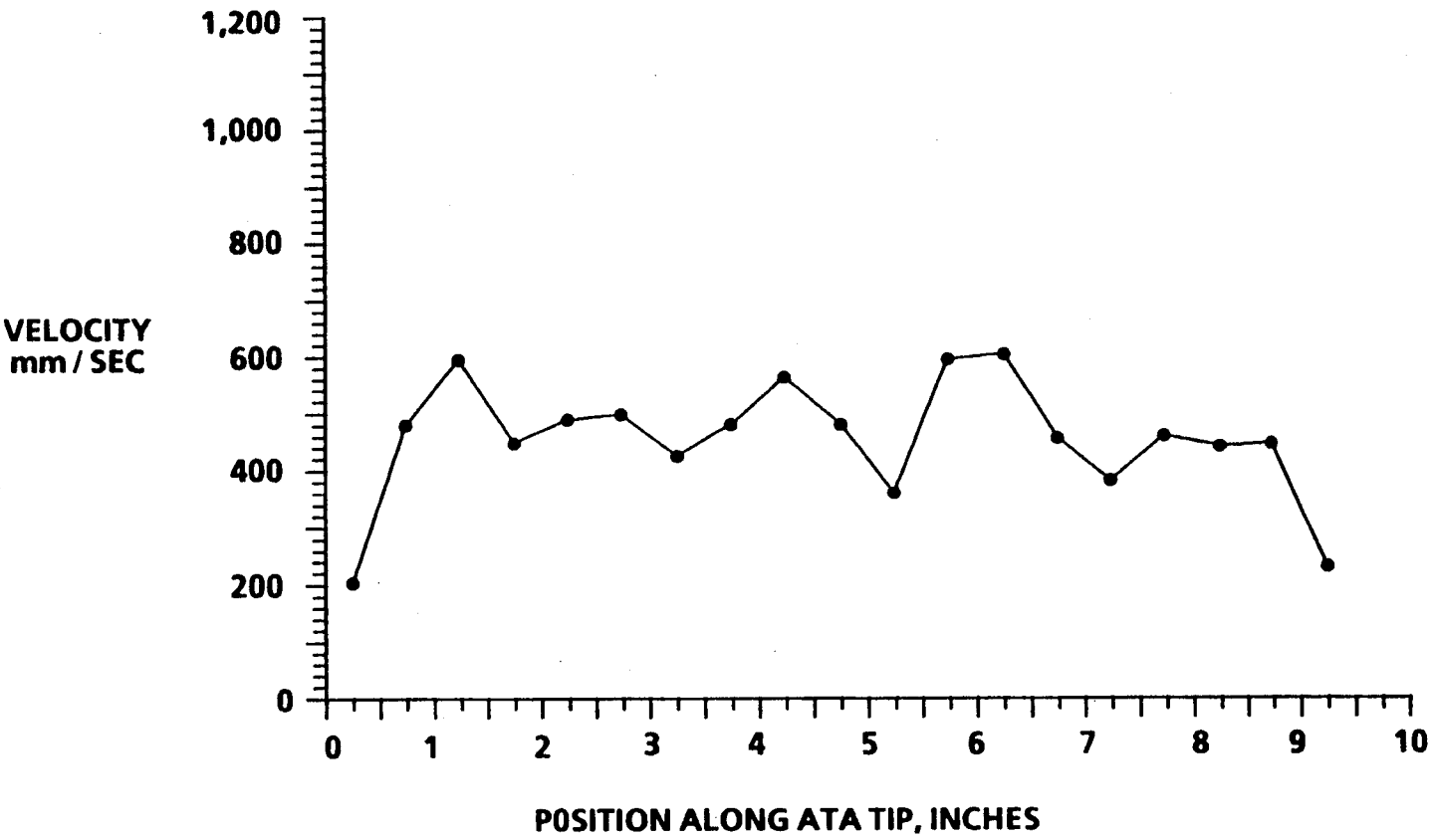
Figure 12A:
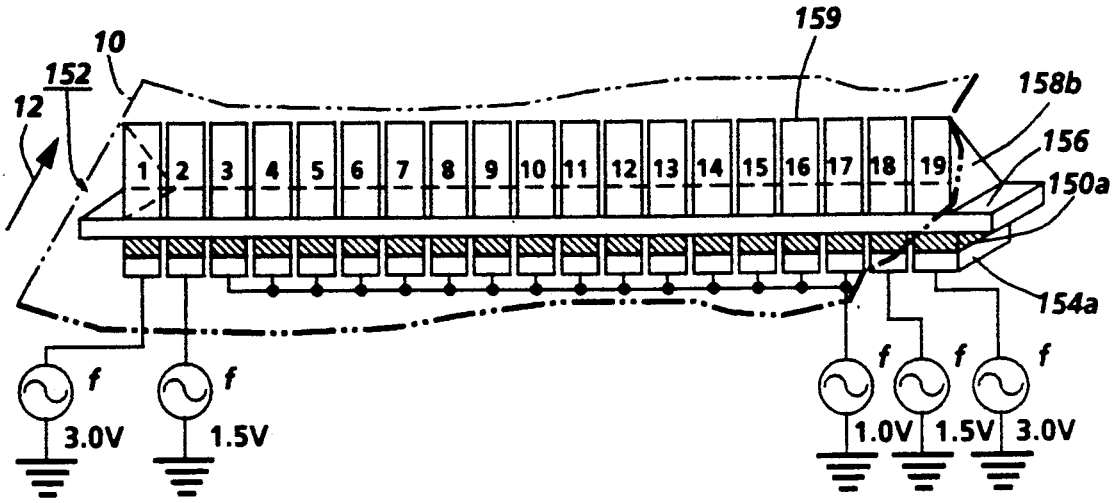
Figure 12B:
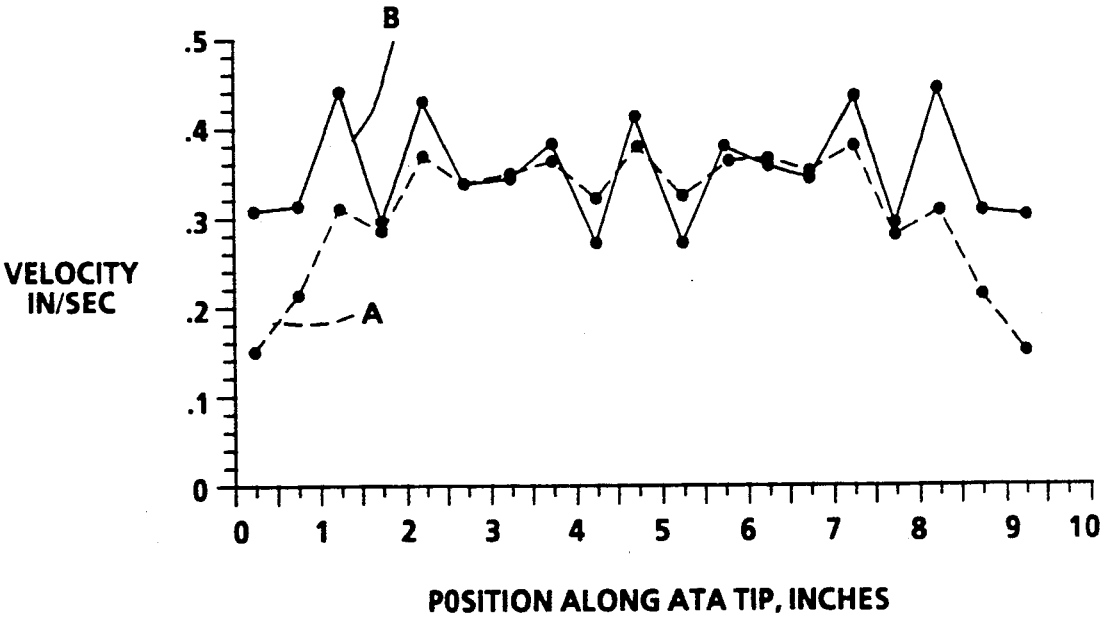
Figure 13:
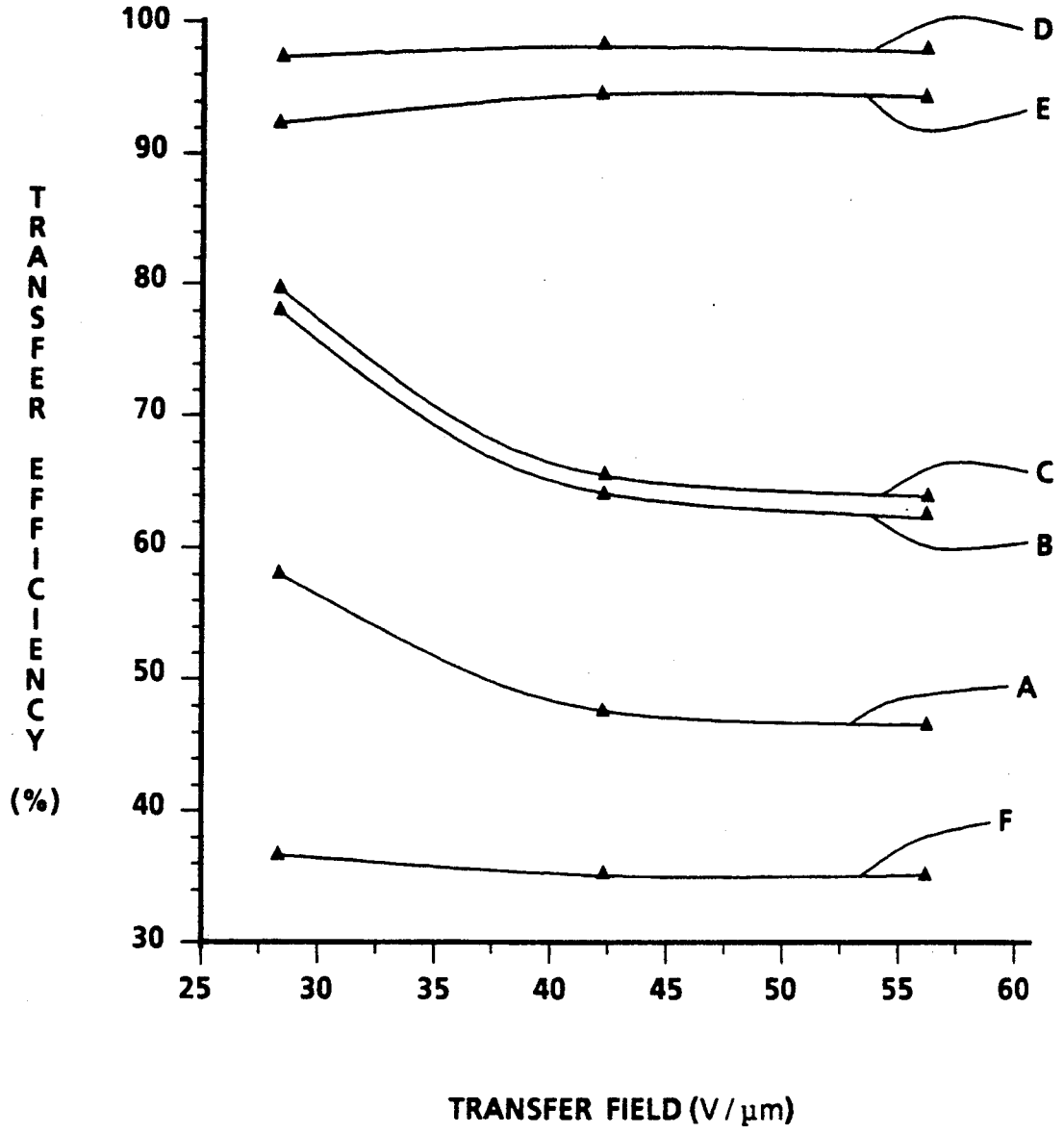

FIG. 11A and 11B respectively show the response of a resonator when excited at a single frequency and when excited over a range of frequencies;

FIGS. 12A and 12B respectively show a resonator and its driving arrangement, and a comparison of responses when each segment is excited with a common voltage and when excited with individually selected voltages; and FIG. 13 shows a plot of transfer efficiency and transfer field for different positions of the transducer.

Referring now to the drawings, where the showings are for the purpose of describing a preferred embodiment of the invention and not for limiting same, the various processing stations employed in the reproduction machine illustrated in FIG. 1 will be described only briefly. It will no doubt be appreciated that the various processing elements also find advantageous use in electrophotographic printing applications from an electronically stored original.

A reproduction machine in which the present invention finds advantageous use utilizes a photoreceptor belt 10. Belt 10 moves in the direction of arrow 12 to advance successive portions of the belt sequentially through the various processing stations disposed about the path of movement thereof.

Belt 10 is entrained about stripping roller 14, tension roller 16, idler rollers 18, and drive roller 20. Drive roller 20 is coupled to a motor (not shown) by suitable means such as a belt drive.

Belt 10 is maintained in tension by a pair of springs (not shown) resiliently urging tension roller 16 against belt 10 with the desired spring force. Both stripping roller 18 and tension roller 16 are rotatably mounted. These rollers are idlers which rotate freely as belt 10 moves in the direction of arrow 16.

Figure 1:
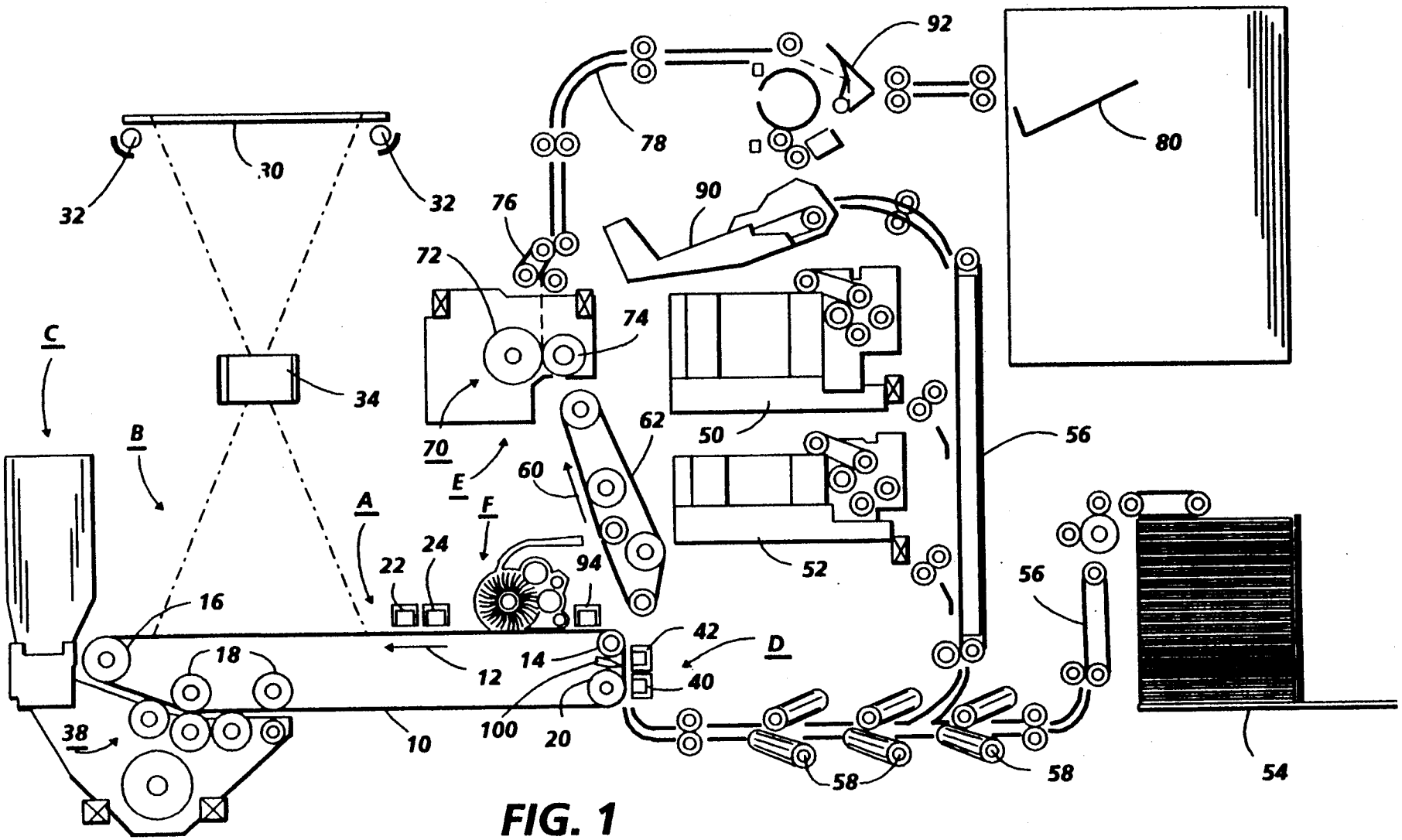
FIG. 1 is a schematic elevational view depicting an electrophotographic printing machine incorporating the present invention.

With continued reference to FIG. 1, initially a portion of belt 10 passes through charging station A. At charging station A, a pair of corona devices 22 and 24 charge photoreceptor belt 10 to a relatively high, substantially uniform negative potential.

At exposure station B, an original document is positioned face down on a transparent platen 30 for illumination with flash lamps 32. Light rays reflected from the original document are reflected through a lens 34 and projected onto a charged portion of photoreceptor belt 10 to selectively dissipate the charge thereon. This records an electrostatic latent image on the belt which corresponds to the informational area contained within the original document.

Thereafter, belt 10 advances the electrostatic latent image to development station C. At development station C, a developer unit 38 advances one or more colors or types of developer mix (i.e. toner and carrier granules) into contact with the electrostatic latent image. The latent image attracts the toner particles from the carrier granules thereby forming toner images on photoreceptor belt 10. As used herein, toner refers to finely divided dry ink, and toner suspensions in liquid.

Belt 10 then advances the developed latent image to transfer station D. At transfer station D, a sheet of support material such as a paper copy sheet is moved into contact with the developed latent images on belt 10. First, the latent image on belt 10 is exposed to a pretransfer light from a lamp (not shown) to reduce the photoreceptor potential in the toner image area. Next, corona generating device 40 charges the copy sheet to the proper potential so that it is tacked to photoreceptor belt 10 and the toner image is attracted from photoreceptor belt 10 to the sheet. After transfer, a corona generator 42 charges the copy sheet with an opposite polarity to detack the copy sheet for belt 10, whereupon the sheet is stripped from belt 10 at stripping roller 14. The support material may also be an intermediate surface or member, which carries the toner image to a subsequent transfer station for transfer to a final substrate. These types of surfaces are also charge retentive in nature. Further, while belt type members are described herein, it will be recognized that other substantially non-rigid or compliant members may also be used with the invention.

Sheets of support material are advanced to transfer station D from supply trays 50, 52 and 54, which may hold different quantities, sizes and types of support materials. Sheets are advanced to transfer station D along conveyor 56 and rollers 58. After transfer, the sheet continues to move in the direction of arrow 60 onto a conveyor 62 which advances the sheet to fusing station E.

Fusing station E includes a fuser assembly, indicated generally by the reference numeral 70, which permanently affixes the transferred toner images to the sheets. Preferably, fuser assembly 70 includes a heated fuser roller 72 adapted to be pressure engaged with a back-up roller 74 with the toner images contacting fuser roller 72. In this manner, the toner image is permanently affixed to the sheet.

After fusing, copy sheets bearing fused images are directed through decurler 76. Chute 78 guides the advancing sheet from decurler 76 to catch tray 80 or a finishing station for binding, stapling, collating etc. and removal from the machine by the operator. Alternatively, the sheet may be advanced to a duplex tray 90 from duplex gate 92 from which it will be returned to the processor and conveyor 56 for receiving second side copy.

A pre-clean corona generating device 94 is provided for exposing the residual toner and contaminants (hereinafter, collectively referred to as toner) to corona to thereby narrow the charge distribution thereon for more effective removal at cleaning station F. It is contemplated that residual toner remaining on photoreceptor belt 10 after transfer will be reclaimed and returned to the developer station C by any of several well known reclaim arrangements, and in accordance with arrangement described below, although selection of a non-reclaim option is possible.

As thus described, a reproduction machine in accordance with the present invention may be any of several well known devices. Variations may be expected in specific processing, paper handling and control arrangements without affecting the present invention.

Figure 2:
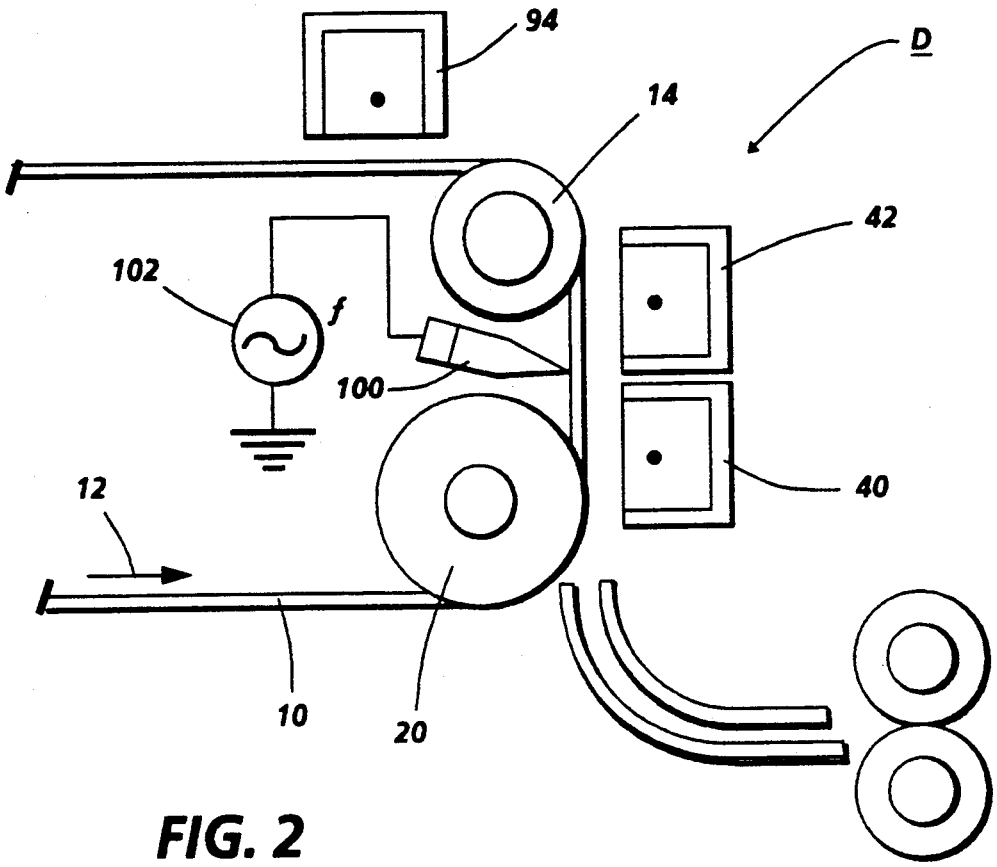
FIG. 2 is a schematic illustration of the transfer station and the associated ultrasonic transfer enhancement device of the invention.

With reference to FIG. 2, the basic concept of the present invention is illustrated schematically. A relatively high frequency acoustic or ultrasonic resonator 100 driven by an A.C. source 102 operated at a frequency f between 20 kHz and 200 kHz, is arranged in vibrating relationship with the interior or back side of belt 10, at a position closely adjacent to where the belt passes through transfer station D. Vibration of belt 10 agitates toner developed in imagewise configuration onto belt 10 for mechanical release thereof from belt 10, allowing the toner to be electrostatically attracted to a sheet during the transfer step, despite gaps caused by imperfect paper contact with belt 10. Additionally, increased transfer efficiency with lower transfer fields than normally used appears possible with the arrangement. Lower transfer fields are desirable because the occurrence of air breakdown (another cause of image quality defects) is reduced. Increased toner transfer efficiency is also expected in areas where contact between the sheet and belt 10 is optimal, resulting in improved toner use efficiency, and a lower load on the cleaning system F. In a preferred arrangement, the resonator 100 is arranged with a vibrating surface parallel to belt 10 and transverse to the direction of belt movement 12, generally with a length approximately co-extensive with the belt width. The belt described herein has the characteristic of being non-rigid, or somewhat flexible, to the extent that it can be made to follow the resonator vibrating motion.

Figure 3A:
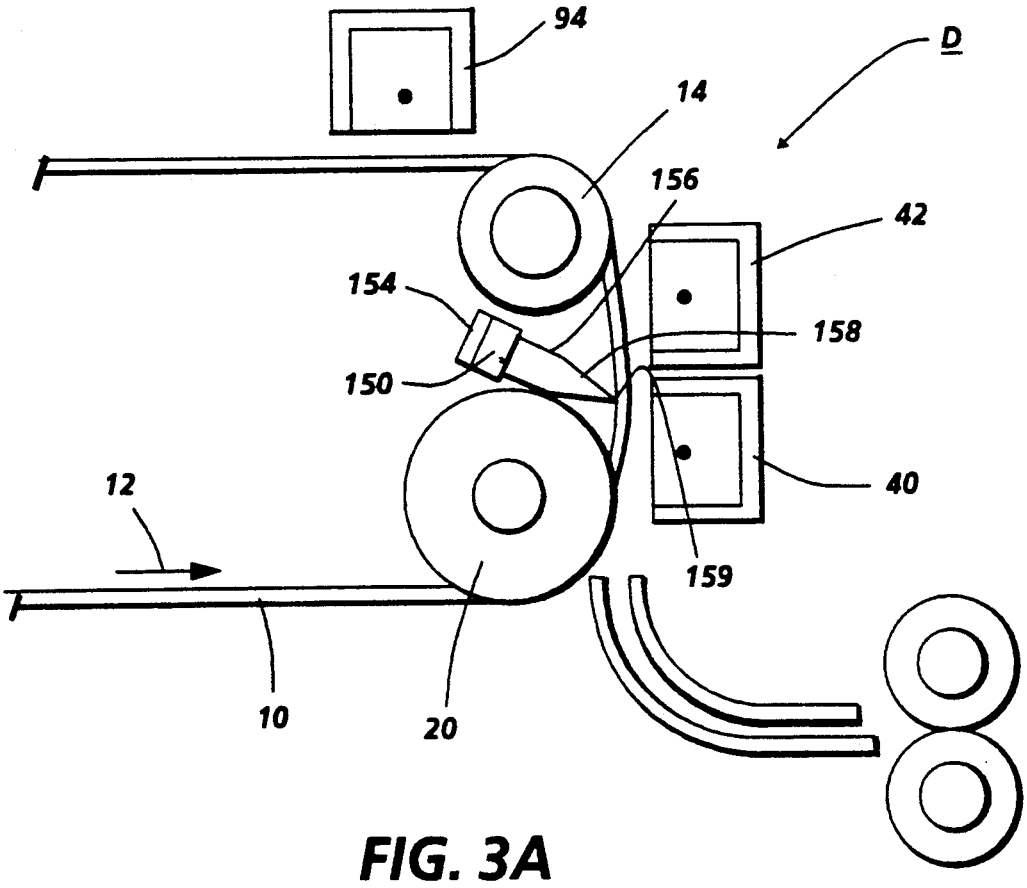
FIGS. 3A and 3B illustrate schematically two arrangements to mechanically couple an ultrasonic resonator to an imaging surface.
Figure 3B:
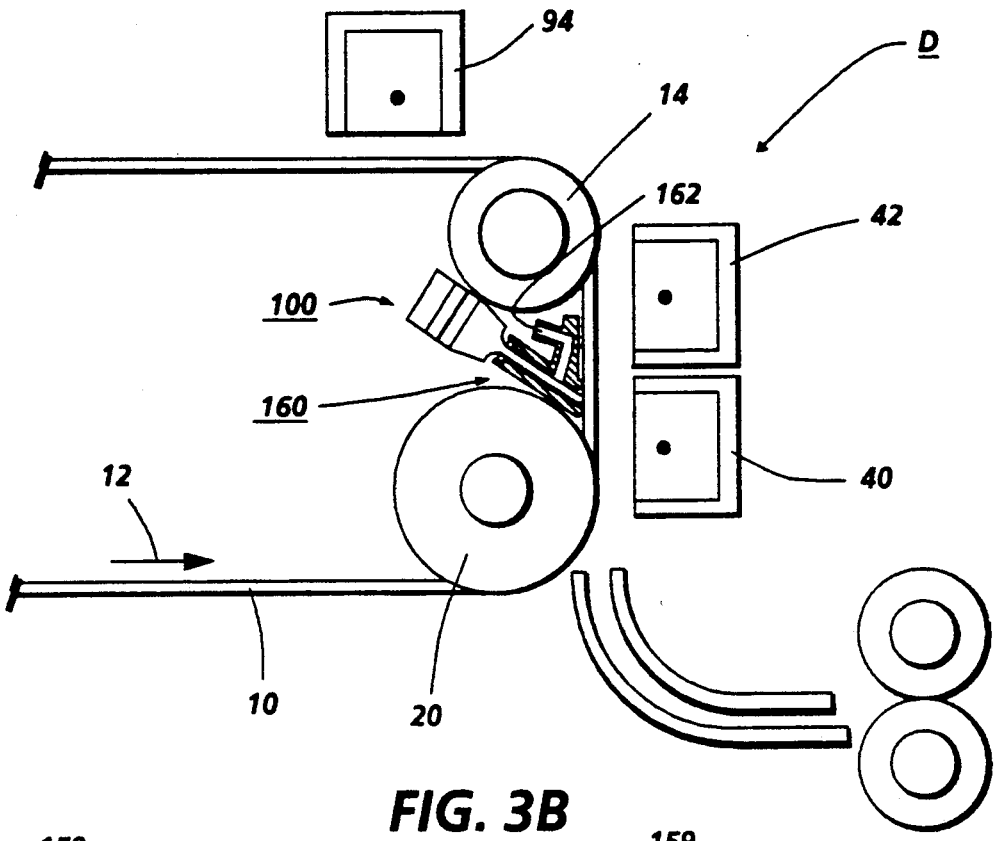

With reference to FIGS. 3A and 3B, the vibratory energy of the resonator 100 may be coupled to belt 10 in a number of ways. In the arrangement of FIG. 3A, resonator 100 may comprise a piezoelectric transducer element 150 and horn 152, together supported on a backplate 154. Horn 152 includes a platform portion 156 and a horn tip 158 and a contacting tip 159 in contact with belt 10 to impart the acoustic energy of the resonator thereto. To hold the arrangement together, fasteners (not shown) extending through backplate 154, piezoelectric transducer element 150 and horn 152 may be provided. Alternatively, an adhesive epoxy and conductive mesh layer may be used to bond the horn and piezoelectric transducer element together, without the requirement of a backing plate or bolts. Removing the backplate reduces the tolerances required in construction of the resonator, particularly allowing greater tolerance is the thickness of the piezoelectric element.

The contacting tip 159 of horn 152 may be brought into a tension or penetration contact with belt 10, so that movement of the tip carries belt 10 in vibrating motion. Penetration can be measured by the distance that the horn tip protrudes beyond the normal position of the belt, and may be in the range of 1.5 to 3.0 mm. It should be noted that increased penetration produces a ramp angle at the point of penetration. For particularly stiff sheets, such an angle may tend to cause lift at the trail edges thereof.

Figure 4A:
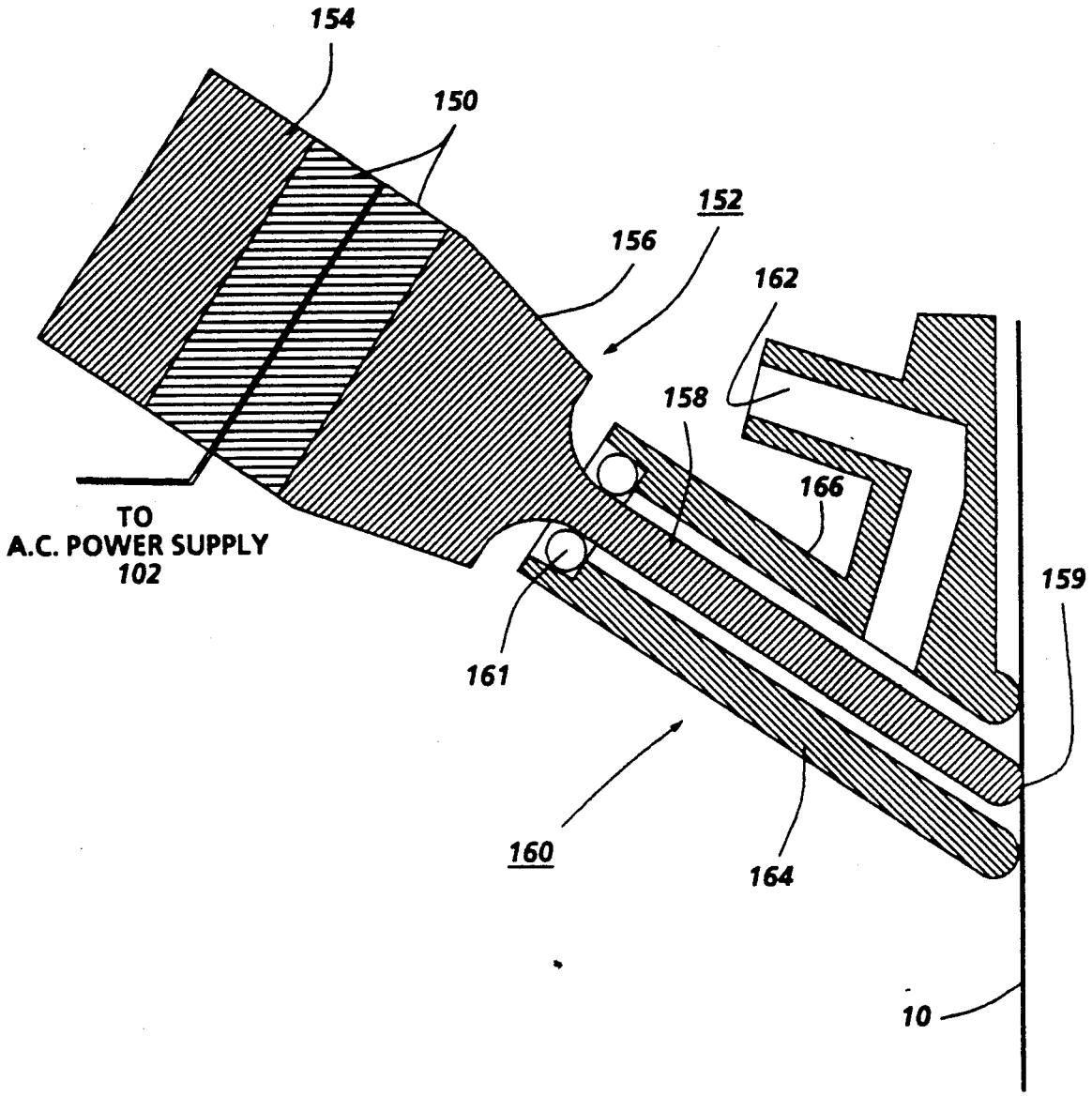
FIG. 4A and 4B are cross sectional views of vacuum coupling assemblies in accordance with the invention.

FIG. 3B and FIG. 4A shows another coupling arrangement, in which the resonator is surrounded by a vacuum box that provides a vacuum coupling arrangement with the belt. Resonator 100, again comprising piezoelectric transducer element 150 and horn 152, where horn 152 includes a platform portion 156, horn tip 158, and contacting tip 159, is surrounded by vacuum box 160, which is coupled to a vacuum source (not shown) via outlet 162 formed in one or more locations along the length of walls 164 or 166 of vacuum box 160. Walls 164 and 166 are approximately parallel to horn tip 156, extending to a common plane with the the horn tip. When a vacuum is applied to vacuum box 160, belt 10 is drawn in to contact with walls 164 and 166 and contacting horn tip 159, so that contacting horn tip 159 imparts the acoustic energy of the resonator to belt 10. Interestingly, walls 164 or 166 of vacuum box 160 also tend to damp vibration of the belt outside the area in which vibration is desired, so that the vibration does not disturb the dynamics of the sheet tacking or detacking process or the integrity of the developed image.

Figure 4B:
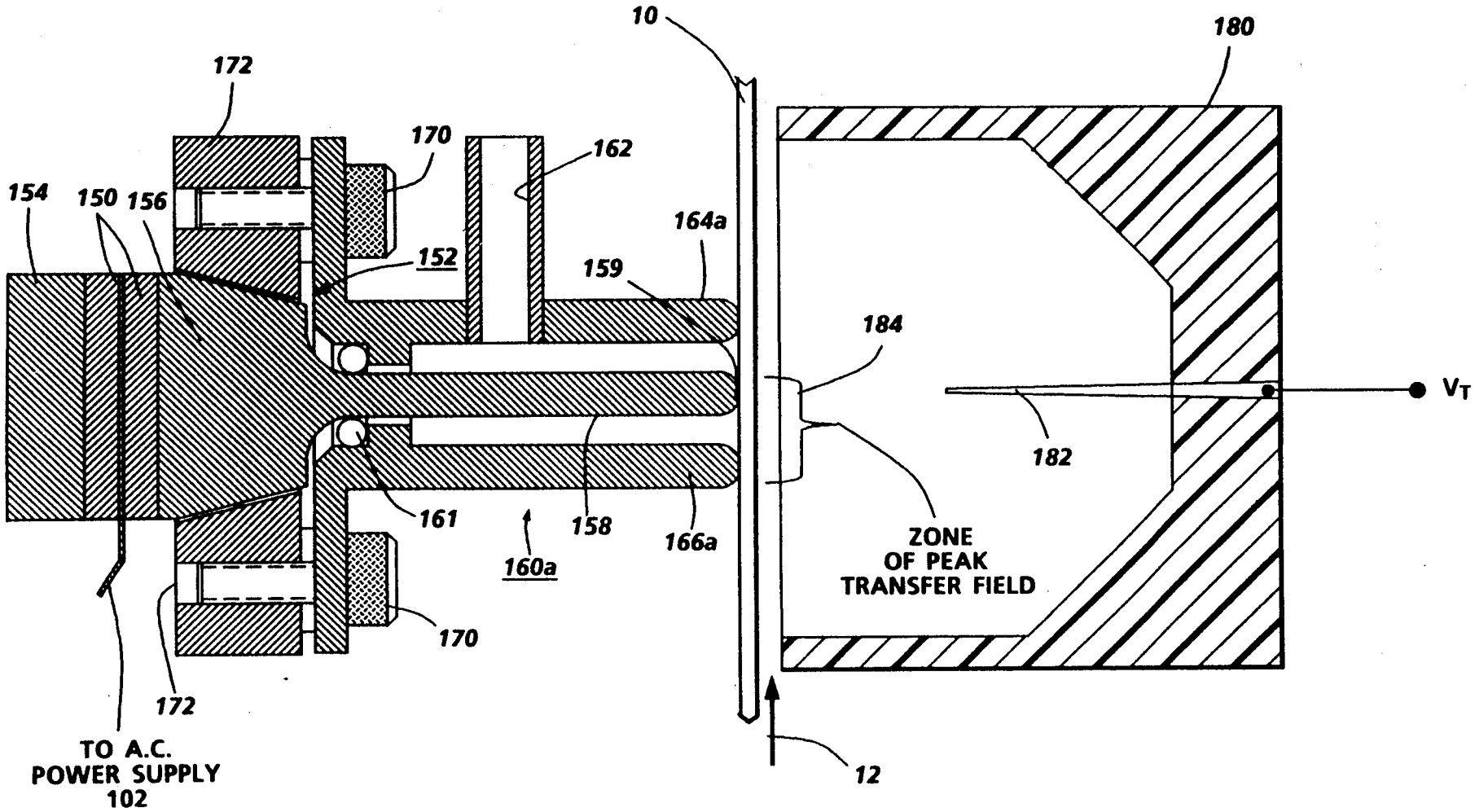

FIG. 4B shows a similar embodiment for coupling the resonator to the backside of photoreceptor 10, but arranged so that the box walls **164*a* and 166*b* and horn tip 158 may be arranged substantially perpendicular to the surface of photoreceptor 10. Additionally, a set of fasteners 170 is used in association with a bracket 172 mounted to the resonator 100 connect the vacuum box 160*a* to resonator 100. Shown in FIG. 4B is the approximate relationship of the resonator with a transfer corotron housing 180, having a pin array coronode 182. The zone of peak transfer field is shown within the bracket 184** about the zone on the photoreceptor.

Application of high frequency acoustic or ultrasonic energy to belt 10 occurs within the area of application of the transfer field, and preferably within the area under transfer corotron 40. While transfer efficiency improvement appears to be obtained with the application of high frequency acoustic or ultrasonic energy throughout the transfer field, in determining an optimum location for the positioning of resonator 100, it has been noted that transfer efficiency improvement is at least partially a function of the velocity of the contacting horn tip 159. As tip velocity increases, it appears that a desirable position of the resonator is approximately opposite the centerline of the transfer corotron. For this location, optimum transfer efficiency was obtained for tip velocities in the range of 300–500 mm/sec. Measurements have been made for a tip velocity of about 300 and 500 mm/sec, in which optimum transfer efficiency was noted with placement of the resonator 2 mm upstream from the coronode. At very low tip velocity, from 0 mm/second to 45 mm/sec, the positioning of the transducer has relatively little effect on transfer characteristics. Restriction of application of vibrational energy, so that the vibration does not occur outside the transfer field is preferred. Application of vibrational energy outside the transfer field tends to cause greater electromechanical adherence of toner to the surface, a problem for subsequent transfer or cleaning.

Figure 8A:
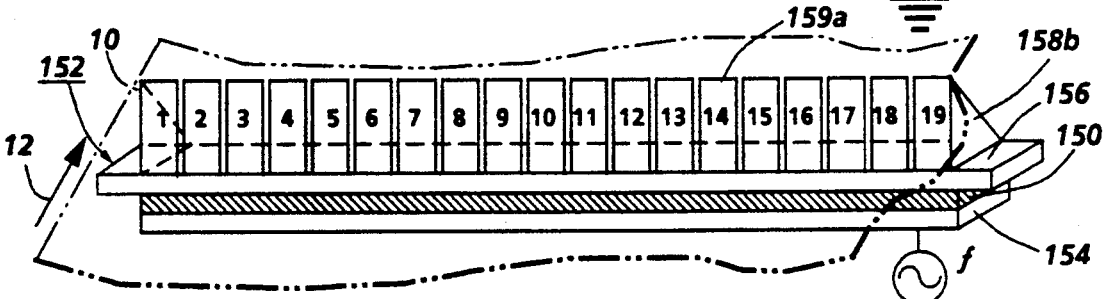
FIGS. 8A and 8B are, respectively, a view of yet another resonator and a graph of the response across the tip at a selected frequency.

Transfer performance studies with a Xerox 1065 copier, a copier having a corotron transfer system, show that transfer can be greatly improved by choosing both the magnitude of transfer field and the location of the transducer in the transfer zone. FIG. 13 is a plot of measured transfer efficiency (%) versus transfer field (V/um) as a function of transducer centerline location relative to that of the transfer coronode. Curves A, B, and C refer to the transfer behavior achieved in the presence of a 76 μm airgap created between the paper and photoreceptor. The upper two curves D, E were obtained in the absence of a gap, with and without the application of vibratory energy, respectively to cause mechanical toner release. The acoustic excitation increased the "no gap" transfer efficiency, indicated by curve D, to a level approaching 98%. The lowest curve F is the base case, wherein a 76 μm gap was induced between a sheet and the photoreceptor, and transfer performance without the application of high frequency energy was measured. The behavior was poor and relatively insensitive to transfer field variation. Introducing vibratory energy excitations (curve A) slightly downstream (6 mm post transfer), through line contact of the described resonator arrangement, with vacuum coupling as shown in FIGS. 3B and 4B, and with a segmented horn tip, as shown in FIG. 8A, the transfer coronode offered some improvement and introduced a transfer field dependency favoring a lower value of the transfer field. A much greater improvement was obtained when locating the transducer either directly opposite the transfer coronode or slightly upstream (6 mm, pre-transfer). These results showed that the introduction of acoustic excitation at selected excitation velocities in the range of 0.225 to 0.375 m/sec improved transfer performance both in the presence and absence of an airgap. The much larger accompanying gain needed for total function suggests that the transducer be located prior to (but near) or opposite the transfer coronode. A lower transfer field is essential to enhancement of transfer performance. The optimum field value and resonator location is therefore believed to be dependent on the transfer corotron current profile (in the process direction) and toner material electrical/mechanical properties. The lower limit field value will be partially dictated by the required electrostatic paper tacking forces.

It should be noted that transfer efficiency is not the only measure of the quality of transfer. Image degradation, edge acuity, or line growth also provide measures of transfer process quality. It is noted that best results are obtained when locating the transducer either directly opposite the transfer coronode, and very close upstream positions, with improving results noted as the transducer is brought toward the transfer coronode position, or toward the peak field position.

Figure 5A:
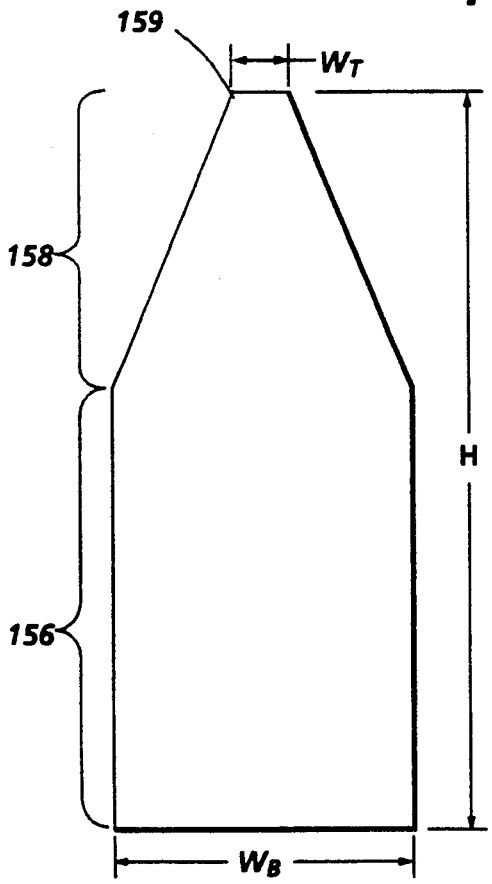
FIGS. 5A and 5B are cross sectional views of two types of horns suitable for use with the invention.
Figure 5B:
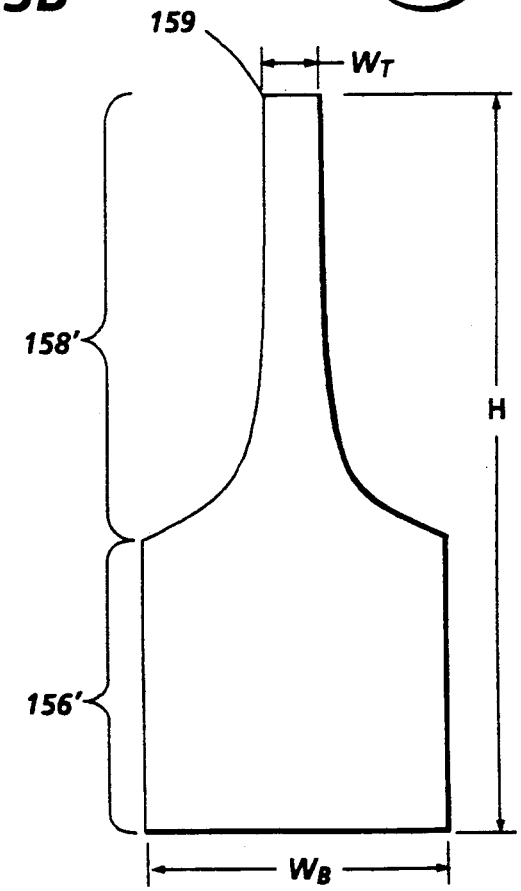

At least two shapes for the horn have been considered. With reference to FIGS. 5A, in cross section, the horn may have a trapezoidal shape, with a generally rectangular base 156 and a generally triangular tip portion 158, with the base of the triangular tip portion having approximately the same size as the base. Alternatively, as shown in FIG. 4B, in cross section, the horn may have what is referred to as a stepped shape, with a generally rectangular base portion 156', and a stepped horn tip 158'. The trapezoidal horn appears to deliver a higher natural frequency of excitation, while the stepped horn produces a higher amplitude of vibration. The height H of the horn has an affect on the frequency and amplitude response, with a shorter tip to base height delivering higher frequency and a marginally greater amplitude of vibration. Desirably the height H of the horn will fall in the range of approximately 1 to 1.5 inches (2.54 to 3.81 cm), with greater or lesser lengths not excluded. The ratio of the base width $W_B$ to tip width $W_T$ also affects the amplitude and frequency of the response with a higher ratio producing a higher frequency and a marginally greater amplitude of vibration. The ratio of $W_B$ to $W_T$ is desirably in the range of about 3:1 to about 6.5:1. The length L of the horn across belt 10 also affects the uniformity of vibration, with the longer horn producing a less uniform response. A desirable material for the horn is aluminum. Satisfactory piezoelectric materials, including lead zirconate-lead titanate composites, sold under the trademark PZT by Vernitron, Inc. (Bedford, Ohio), have high $D_{33}$ values. Displacement constants are typically in the range of 400–500 $m \times 10^{-12}/v$. There may be other sources of vibrational energy, which clearly support the present invention, including but not limited to magnetostriction and electrodynamic systems.

Figure 6A:
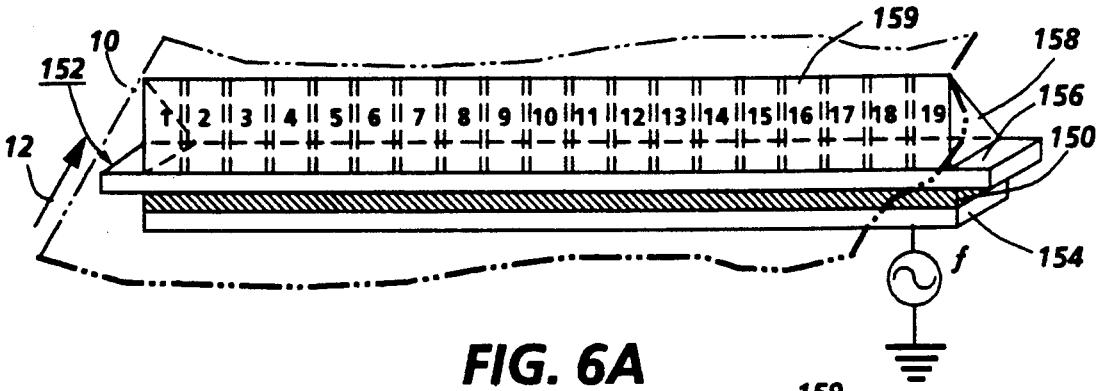
FIGS. 6A and 6B are, respectively, views of a resonator and a graph of the resonator response across the tip at a selected frequency.
Figure 6B:
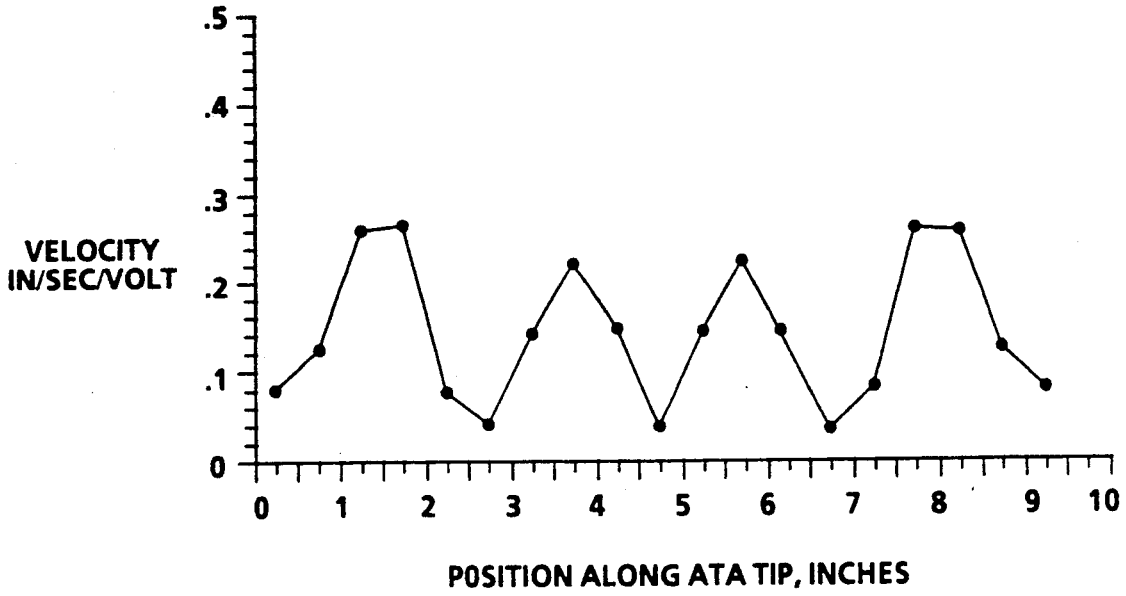

In considering the structure of the horn 152 across its length L, several concerns must be addressed. It is highly desirable for the horn to produce a uniform response along its length, or non-uniform transfer characteristics may result. It is also highly desirable to have a unitary structure, for manufacturing and application requirements. If horn 152, is a continuous member across its length as shown in FIG. 6A, with a continuous piezoelectric transducer 150, the combination supported on a continuous backing plate 154, the combination provides a structure desirable for its simplicity in structure. There is, however, a tendency for the contacting tip 159 of the horn to vary in characteristics of vibration, as illustrated in FIG. 6B, which illustrates the velocity response at an array of points 1–19 along the horn tip, varying from about 0.03 in/sec/v to 0.28 in/sec/v (0.076 cm/sec/vto 0.71 cm/sec/v), when excited at a frequency of 62.6 kHz. It is further noted that positions along the contacting horn tip 159 have differing natural frequencies of vibration, where the device produce maximum tip velocities caused by different modes of vibration.

Figure 7A:
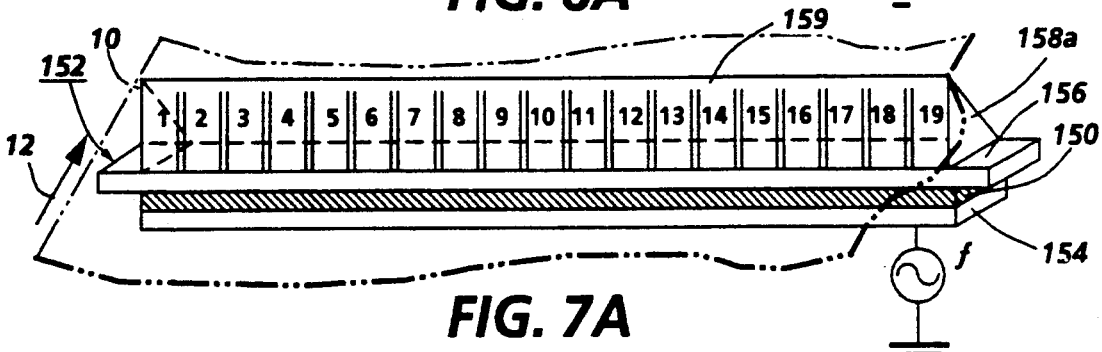
FIGS. 7A and 7B are, respectively, a view of another resonator and a graph of the response across the tip at a selected frequency.
Figure 7B:
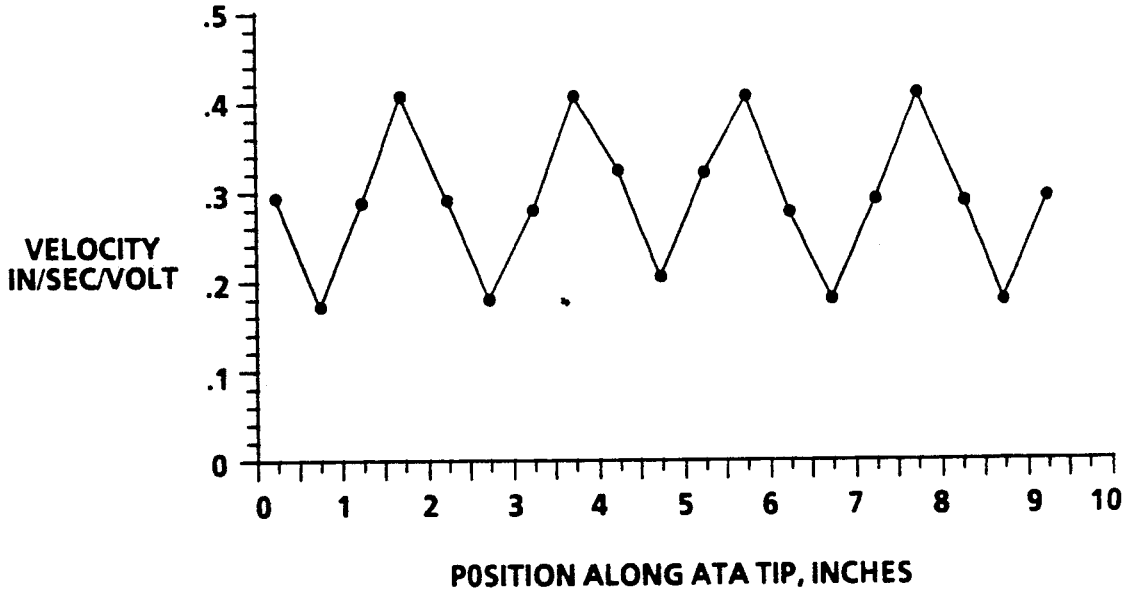

When horn 152 is segmented, each horn segment tends to act as an individual horn. Two types of horn segmentation may be used, as shown in FIGS. 7A and 8A. In FIG. 7A a partial horn segmentation is shown, where the tip portion **158*a* of horn 152 is cut perpendicularly to the plane of the imaging surface, and generally parallel to the direction of imaging surface travel, but not cut through the contacting tip 159 of the horn, while a continuous piezoelectric transducer 150, and a continuous backing plate 154 are maintained. Such an arrangement, which produces an array of horn segments 1-19, improves the response along the contacting horn tip, as shown in FIG. 7B, which illustrates the velocity response along the array of horn segments 1-19** along the horn tip, varying from about 0.18 in/sec/v to 0.41 in. sec/v (0.46 cm/sec/v to 1.04 cm/sec/v), when excited at a frequency of 61.1 kHz. The response tends to be more uniform across the tip, but some cross coupling is still observed. It is noted that the velocity response is greater across the segmented horn tip, than across the unsegmented horn tip, a desirable result. It will be understood that the exact number of segments may vary significantly from the 19 segments shown in the examples and described herein. The length $L_s$ of any segment is selected in accordance with the height H of the horn, with the ration of H to $L_s$ falling in a range of greater that 1:1, and preferably about 3:1.

Figure 8B:
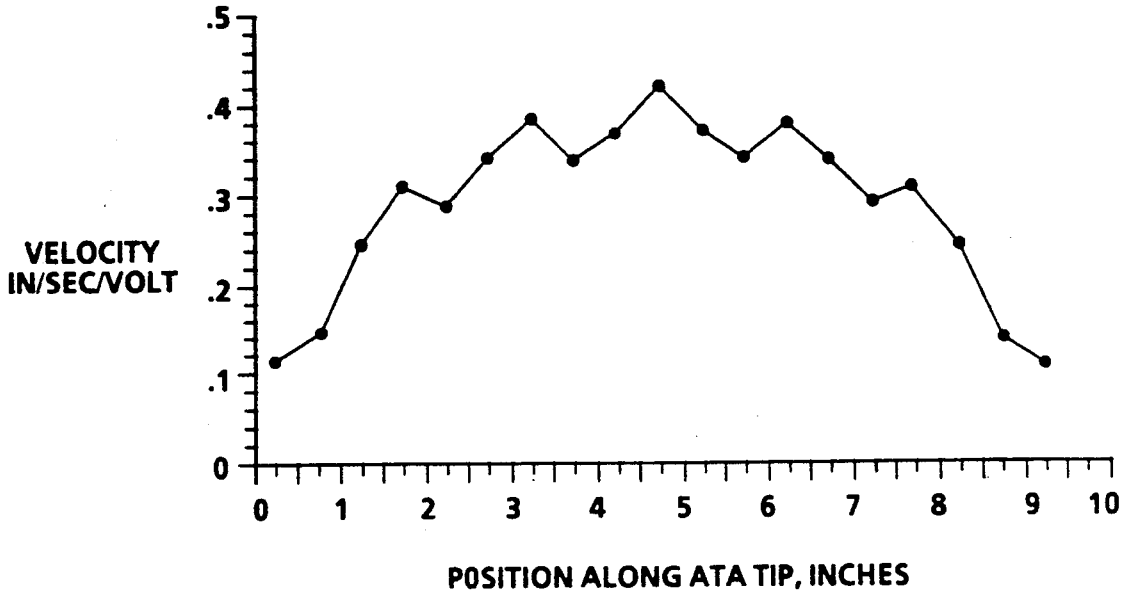

In FIG. 8A a full horn segmentation is shown, where the horn 152 is cut perpendicularly to the plane of the imaging surface, and generally parallel to the direction of imaging surface travel, and cut through contacting tip 159*a* of the horn and through tip portion 158*b*, but maintaining a continuous platform portion 156. When the horn is segmented though the tip, producing an open ended slot, each segment acts more or less individually in its response. As shown in FIG. 8B, which illustrates the velocity response along the array of horn segments 1-19 along the horn tip, the velocity response varies from from about 0.11 in/sec/v to 0.41 in/sec/v (0.28 cm/sec/v to 0.97 cm/sec/v), when excited at a frequency of 61.1 kHz making the response more uniform across the tip, but still tending to demonstrate a variability in vibration caused by cross coupling across the tip of the horn. It is noted that the velocity response is greater across the segmented horn tip, than across the unsegmented horn tip, a desirable result. The overall curve shows a more uniform response, particularly between adjacent segments along the array of segments.

Figure 9A:
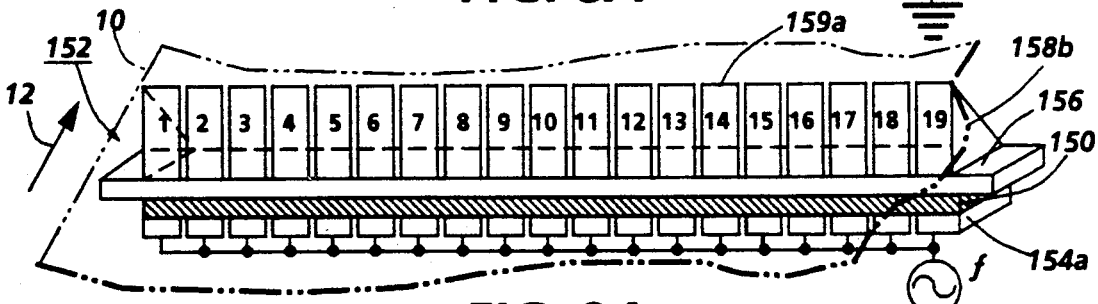
FIGS. 9A and 9B are, respectively, a view of still another resonator and a graph of the resonator response across the tip at a selected frequency.
Figure 9B:
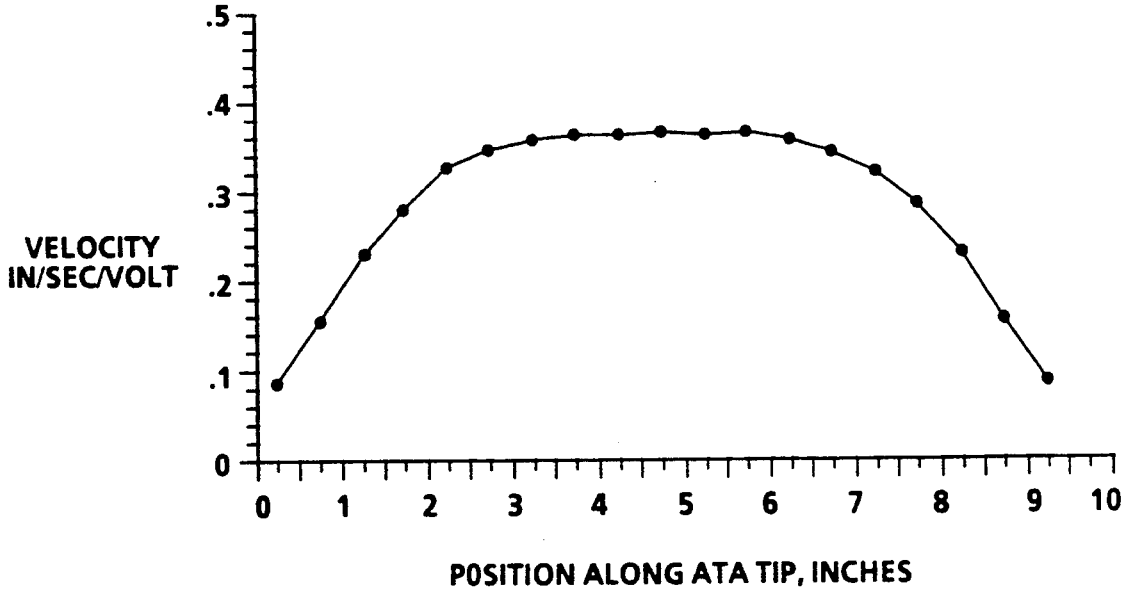

In FIG. 9 fully segmented horn 152 is shown, cut through the contacting tip 159*a* of the horn and through tip portion 158*b*, with continuous platform 156 and piezoelectric element 150, with a segmented backing plate 154*a*. As shown in FIG. 9B, which illustrates the velocity response along the array of horn segments 1-19 along the horn tip, varying from about 0.09 in/sec/v to 0.38 in/sec/v (0.23 cm/sec/v to 0.38 in/sec/v) when excited at a frequency of 61.3 kHz still tending to demonstrate variability do to cross coupling across the tip of the horn. It is noted that the velocity response is greater across the segmented horn tip, than across the unsegmented horn tip, a desirable result. The overall curve shows good uniformity of response between adjacent segments along the array of horn segments.

Figure 10A:
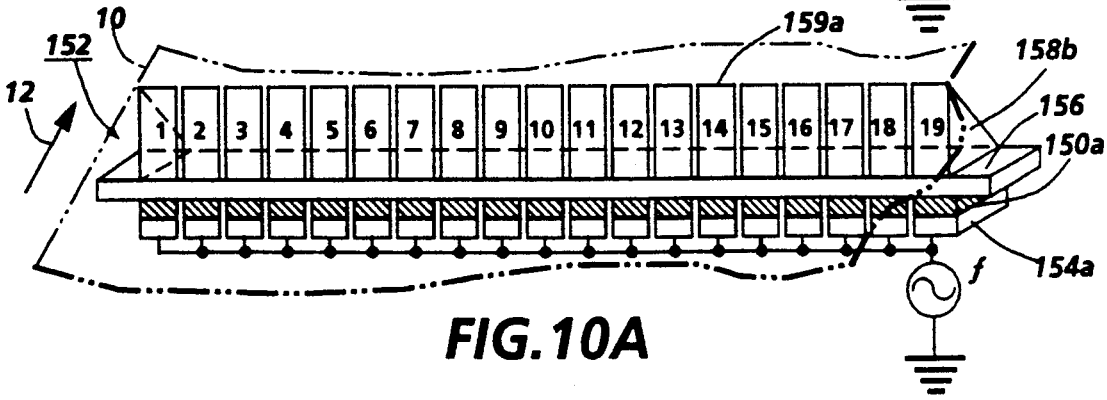
FIGS. 10A and 10B are respectively, a view of another resonator and a graph of the resonator response across the tip at a selected frequency.
Figure 10B:
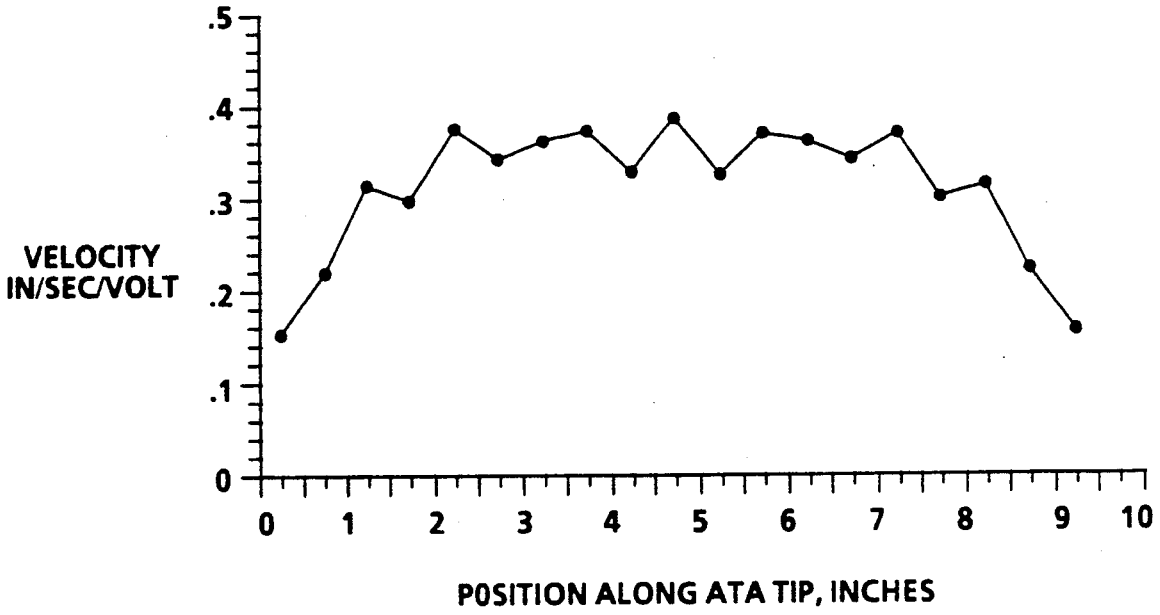

In FIG. 10A, fully segmented horn 152 is shown, cut through the contacting tip 159*a* of the horn and through tip portion 158*b*, with continuous platform 156, a segmented piezoelectric element 150*a* and segmented backing plate 154*a*. As shown in FIG. 10B, overall a more uniform response is noted, although segment to segment response is less uniform than the case where the backing plate was not segmented. Each segment acts completely individually in its response. A high degree of uniformity between adjacent segments is noted.

With reference to FIG. 2, A. C. power supply 102 drives piezoelectric transducer 150 at a frequency selected based on the natural excitation frequency of the horn 160. However, the horn of resonator 100 may be designed based on space considerations within an electrophotographic device, rather than optimum tip motion quality. Additionally if the horn is transversely segmented, as proposed in FIGS. 8A, 9A and 10A, the segments operate as a plurality of horns, each with an individual response rather than a common uniform response. Horn tip velocity is desirably maximized for optimum toner release, but as the excitation frequency varies from a natural excitation frequency of the device, the tip velocity response drops off sharply. FIG. 11A shows the effects of the nonuniformity, and illustrates tip velocity in mm/sec versus position along a sample segmented horn, when a sample horn was excited at a single frequency of 59.0 kHz. The example shows that tip velocity varies at the excitation frequency from less than 100 mm/sec to more than 1000 mm/sec/v along the sample horn. Accordingly, FIG. 11B shows the results where A.C. power supply 102 drives piezoelectric transducer 150 at a range of frequencies selected based on the expected natural excitation frequencies of the horn segments. The piezoelectric transducer was excited with a swept sine wave signal over a range of frequencies 3 kHz wide, from 58 KHz to 61 KHz, centered about the average natural frequency of all the horn segments. FIG. 11B shows improved uniformity of the response with the response varying only from slightly less than 200 mm/sec/v. to about 600 mm/sec/v.

The desired period of the frequency sweep, i.e., sweeps/sec. is based on photoreceptor speed, and selected so that each point along the photoreceptor sees the maximum tip velocity, and experiences a vibration large enough to assist toner transfer. At least three methods of frequency band excitation are available: a frequency band limited random excitation that will continuously excite in a random fashion all the frequencies within the frequency band; a simultaneous excitation of all the discrete resonances of the individual horns with a given band; and a swept sine excitation method where a single sine wave excitation is swept over a fixed frequency band. Of course, many other wave forms besides sinusoidal may be applied. By these methods, a single, or identical dilation mode is obtained for all the horns.

It will also be noted from FIGS. 11A and 11B, as well as other resonator response curves 7B-10B that there is a tendency for the response of the segmented horn segment to fall off at the edges of the horn, as a result of the continuous mechanical behavior of the device. However, uniform response along the entire device, arranged across the width of the imaging surface, is required. To compensate for the edge roll off effect, the piezoelectric transducer elements of the resonator may be segmented into a series of devices, each associated with at least one of the horn segments, with a separate driving signal to at least the edge elements. As shown in FIG. 12A, the resonator of FIG. 10A may be provided with an alternate driving arrangement to compensate for the edge roll off effect, with the piezoelectric transducer elements of the resonator segmented into a series of devices, each associated with at least one of the horn segments, with a separate driving signal to at least the edge elements. As shown in FIG. 12B, in one possible embodiment of the arrangement, wherein a series of 19 corresponding piezoelectric transducer elements and horns are used for measurement purposes, Curve A shows the response of the device where 1.0 volts is applied to each piezoelectric transducer element 1 though 19. Curve B shows a curve where 1.0 volts is applied to piezoelectric transducer elements 3–17, 1.5 volts is applied to piezoelectric transducer elements 2 and 18 and 3.0 volts is applied to piezoelectric transducer elements 1 and 19, as illustrated in FIG. 12A. As a result, curve B is significantly flattened with respect to curve A, for a more uniform response. Each of the signals applied is in phase, and in the described arrangement is symmetric to achieve a symmetric response across the resonator. Of course, instead of providing a piezoelectric element for each horn segment, separate piezoelectric elements for the outermost horn segments might be provided, with a continuous element through the central region of the resonator, to the same effect.

The invention has been described with reference to a preferred embodiment for transfer from a photoreceptor to a paper sheet. In a slightly different arrangement, toner may be transferred from a photoreceptor to an intermediate surface, prior to retransfer to a final substrate. Obviously modifications will occur to others upon reading and understanding the specification taken together with the drawings. This embodiment is but one example, and various alternatives, modifications variations or improvements may be made by those skilled in the art from this teaching which are intended to be encompassed by the following claims.

I claim:

1. In an imaging device having a non-rigid member with a first charge retentive surface, moving in a process direction along an endless path, means for producing a toner image on the charge retentive surface, corona transfer device, having at least a first coronode driven with a relatively high voltage to a corona producing condition for providing non-contacting electrostatic transfer of the developed toner image within a transfer field to a second surface in contact with said charge retentive surface, said coronode supported within said corotron arranged generally, parallel to said charge retentive surface and transverse to the direction of movement thereof, and means for enhancing transfer of said developed image to said second surface across areas of less than optimal contact said transfer enhancing means including:

vibratory energy producing means, mechanically coupled in line contact with a second surface of said non-rigid member, applying vibratory energy enabling toner release from the charge retentive surface, at a position prior to and near, or opposite, the region where the transfer field is approaching its peak value.

2. The device as defined in claim 1 wherein said vibratory energy producing means includes a piezoelectric device excited by an A.C. voltage supply.

3. The device as defined in claim 2 wherein A.C. voltage supply is driven at a frequency in the range of 20 kHz to 200 kHz.

4. The device as defined in claim 2 wherein said piezoelectric device is excited to produce an output in the range of 20 kHz to 200 KHz.

5. In an imaging device having a non-rigid member moving in a process direction along an endless path having a first charge retentive surface, means for producing a toner image on the charge retentive surface, a corona transfer device having at least a first coronode driven with a relatively high voltage to a corona producing condition for providing non-contacting electrostatic transfer of the developed toner image within a transfer field to a second surface in contact with said charge retentive surface, said coronode supported within said corotron generally parallel to said charge retentive surface and transverse to the direction of movement thereof, and means for enhancing transfer of said developed image to said second surface, said transfer enhancing means including:

vibratory energy producing means, mechanically coupled in line contact with a second surface of said non-rigid member, applying vibratory energy enabling toner release from the charge retentive surface, at a position slightly upstream from the coronode, in a direction opposite to the process direction.

6. The device as defined in claim 5 wherein said vibratory energy producing means is arranged within the transfer field of the transfer corona generator and within 10 mm upstream in a direction opposite to the process direction, from the coronode.

7. The device as defined in claim 5 wherein said vibratory energy producing means includes a piezoelectric device excited by an A.C. voltage supply.

8. The device as defined in claim 7 wherein A.C. voltage supply is driven at a frequency in the range of 20 kHz to 200 kHz.

9. The device as defined in claim 7 wherein said piezoelectric device is excited to produce an output in the range of 20 kHz to 200 kHz.

10. In an imaging device having a non-rigid member with a charge retentive surface moving in a process direction along an endless path, means for creating a latent image on the charge retentive surface, means for developing the latent image with toner, said toner held on said charge retentive surface by electrostatic and mechanical forces, a transfer corona generator having at least a first coronode driven with a relatively high voltage to a corona producing condition for providing electrostatic non-contacting transfer of the developed toner image to a second surface brought into contact with the charge retentive surface, said coronode supported within said corotron and arranged generally parallel to said charge retentive surface and transversely across the direction of movement thereof, and means for enhancing electrostatic transfer of said developed image to said copy sheet, said transfer enhancing means comprising:

a resonator to apply relatively high frequency vibratory energy sufficient to mechanically release said toner from said electrostatic and mechanical forces, arranged in line contact with the non-rigid member, transverse to the process direction, to uniformly apply said vibratory energy to the non-rigid member, at a position at or slightly upstream in a direction opposite the process direction, from the coronode of the corona generator.

11. The device as defined in claim 10 wherein said vibratory energy producing resonator is arranged within the transfer field of the transfer corona generator and within 10 mm upstream in a direction opposite the process direction from the coronode.

12. The device as defined in claim 10 wherein said vibratory energy producing resonator includes a piezoelectric device excited by an A.C. voltage supply.

13. The device as defined in claim 12 wherein A.C. voltage supply is driven at a frequency in the range of 20 kHz to 200 kHz.

14. The device as defined in claim 13 wherein said piezoelectric device is excited to produce an output in the range of 20 kHz to 200 kHz.

15. The device as defined in claims 14 wherein said resonator is supported for line contact with the non-rigid member, said line contact arrangement oriented approximately parallel to the non-rigid member and transverse to the direction of movement of the charge retentive surface along said endless path.

16. The device as defined in claim 14 wherein the non-rigid member has an exterior charge retentive surface, upon which a developed toner image is supported, and an interior surface, on the opposite side thereof, said resonator, mechanically coupled to said interior surface of the non-rigid member.

17. The device as defined in claim 14 wherein said resonator includes a piezoelectric device excited by an A.C. voltage supply.

18. The device as defined in claim 17 wherein A.C. voltage supply is driven at a frequency in the range of 20 kHz to 200 kHz.

19. The device as defined in claim 17 wherein said piezoelectric device is excited to produce an output in the range of 20 kHz to 200 kHz.

20. In an electrophotographic device having a flexible belt-type member with a charge retentive surface moving along an endless path, means for creating a latent image on the charge retentive surface, means for developing the latent image with toner, said toner held on said charge retentive surface by electrostatic and mechanical forces, corona producing transfer means for providing non-contact transfer of the developed toner image to a copy sheet brought into contact with the charge retentive surface, said contact between said sheet and said charge retentive surface characterized by areas of intimate and non-intimate contact, and means for enhancing electrostatic transfer of said developed image to said copy sheet at said areas on non-intimate contact, said transfer enhancing means comprising:

a resonator to apply relatively high frequency vibratory energy to said charge retentive surface within a transfer field generated at said corona producing transfer means, sufficient to mechanically release said toner from said electrostatic and mechanical forces and transfer to the copy sheet at areas of non-intimate contact, and arranged with respect to said charge retentive surface and said transfer field to uniformly apply said high frequency vibratory energy to said charge retentive surface, while said developed toner image to be transferred to said sheet is within said transfer field;

said resonator supported for line contact with said charge retentive surface, said line contact oriented approximately parallel to said charge retentive surface and approximately transverse to the direction of movement thereof along said endless path;

said flexible belt-type member with a charge retentive surface having an exterior surface, upon which a developed toner image is supported, and an interior surface, on the opposite side thereof, said resonator, mechanically coupled to said interior surface of said charge retentive surface.

21. The device as defined in claim 20 wherein said resonator includes a piezoelectric device excited by an A.C. voltage supply.

22. The device as defined in claim 20 wherein A.C. voltage supply is driven at a frequency in the range of 20 kHz to 200 kHz.

23. The device as defined in claim 20 wherein said piezoelectric device is excited to produce an output in the range of 20 kHz to 200 kHz.

24. The device as defined in claim 20 wherein said means for electrostatically transferring the developed toner image to a copy sheet includes a transfer corotron and said ultrasonic energy producing means is mechanically coupled to said charge retentive surface for causing mechanical release of toner from the charge retentive surface at a position within an electrostatic transfer field created by said transfer corotron.

25. In an imaging device having a non-rigid member with a first charge retentive surface, moving in a process direction along an endless path, means for producing a toner image on the charge retentive surface, corona transfer device, having at least a first coronode driven with a relatively high voltage to a corona producing condition for providing non-contacting electrostatic transfer of the developed toner image within a transfer field to a second surface in contact with said charge retentive surface, said coronode supported within said corotron arranged generally, parallel to said charge retentive surface and transverse to the direction of movement thereof, and means for enhancing transfer of said developed image to said second surface across areas of less than optimal contact said transfer enhancing means including:

vibratory energy producing means, mechanically coupled in line contact with a second surface of said non-rigid member, applying vibratory energy enabling toner release from the charge retentive surface, at a position prior to or opposite the transfer device coronode.

26. In an imaging device having a non-rigid member with a first charge retentive surface, moving in a process direction along an endless path, means for producing a toner image on the charge retentive surface, corona transfer device, having at least a first coronode driven with a relatively high voltage to a corona producing condition for providing non-contacting electrostatic transfer of the developed toner image within a transfer field to a second surface in contact with said charge retentive surface, said coronode supported within said corotron arranged generally, parallel to said charge retentive surface and transverse to the direction of movement thereof, and means for enhancing transfer of said developed image to said second surface across areas of less than optimal contact said transfer enhancing means including:

vibratory energy producing means, mechanically coupled in line contact with a second surface of said non-rigid member, applying vibratory energy enabling toner release from the charge retentive surface, at a position directly opposite the transfer device coronode.

27. In an imaging device having a non-rigid member with a first charge retentive surface, moving in a process direction along an endless path, means for producing a toner image on the charge retentive surface, corona transfer device, having at least a first coronode driven with a relatively high voltage to a corona producing condition for providing non-contacting electrostatic transfer of the developed toner image within a transfer field to a second surface in contact with said charge retentive surface, said coronode supported within said corotron arranged generally, parallel to said charge retentive surface and transverse to the direction of movement thereof, and means for enhancing transfer of said developed image to said second surface across areas of less than optimal contact said transfer enhancing means including:

vibratory energy producing means, mechanically coupled in line contact with a second surface of said non-rigid member, applying vibratory energy enabling toner release from the charge retentive surface, at a position prior to and near the region where the transfer field is approaching its peak value.

28. In an imaging device having a non-rigid member with a first charge retentive surface, moving in a process direction along an endless path, means for producing a toner image on the charge retentive surface, corona transfer device, having at least a first coronode driven with a relatively high voltage to a corona producing condition for providing non-contacting electrostatic transfer of the developed toner image within a transfer field to a second surface in contact with said charge retentive surface, said coronode supported within said corotron arranged generally, parallel to said charge retentive surface and transverse to the direction of movement thereof, and means for enhancing transfer of said developed image to said second surface across areas of less than optimal contact said transfer enhancing means including:

vibratory energy producing means, mechanically coupled in line contact with a second surface of said non-rigid member, applying vibratory energy enabling toner release from the charge retentive surface, at a position directly opposite the region where the transfer field is approaching its peak value.

* * * * *